US007686618B2

(12) United States Patent
Mizukami et al.

(10) Patent No.: US 7,686,618 B2
(45) Date of Patent: Mar. 30, 2010

(54) CONNECTOR AND CONNECTOR DEVICE

(75) Inventors: Kazuhiro Mizukami, Shinagawa (JP); Takeshi Okuyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/192,198

(22) Filed: Aug. 15, 2008

(65) Prior Publication Data

US 2009/0233492 A1 Sep. 17, 2009

(30) Foreign Application Priority Data

Mar. 11, 2008 (JP) ..... 2008-061688

(51) Int. Cl.
*H01R 12/00* (2006.01)

(52) U.S. Cl. ..... 439/61

(58) Field of Classification Search ..... 439/61, 439/65, 79, 608; 361/750
See application file for complete search history.

(56) References Cited

U.S. PATENT DOCUMENTS 5,024,609 A * 6/1991 Piorunneck ..... 439/637
5,379,193 A * 1/1995 Gall et al. ..... 361/784
6,206,725 B1 * 3/2001 Wu ..... 439/541.5
6,305,947 B1 * 10/2001 Bruce ..... 439/63
6,609,933 B2 * 8/2003 Yamasaki ..... 439/608
6,666,692 B2 * 12/2003 Billman et al. ..... 439/76.1
6,969,268 B2 * 11/2005 Brunker et al. ..... 439/108
6,979,226 B2 * 12/2005 Otsu et al. ..... 439/608
7,112,067 B1 * 9/2006 Korsunsky et al. ..... 439/65
7,281,950 B2 * 10/2007 Belopolsky ..... 439/608
7,316,585 B2 * 1/2008 Smith et al. ..... 439/608
7,331,802 B2 * 2/2008 Rothermel et al. ..... 439/108
7,384,311 B2 * 6/2008 Sharf et al. ..... 439/608
7,422,484 B2 * 9/2008 Cohen et al. ..... 439/608
7,578,705 B2 * 8/2009 He et al. ..... 439/660
2003/0003803 A1 * 1/2003 Billman et al. ..... 439/608
2003/0008562 A1 * 1/2003 Yamasaki ..... 439/608
2003/0186595 A1 10/2003 Provencher et al.
2005/0032430 A1 * 2/2005 Otsu et al. ..... 439/608
2006/0228911 A1 * 10/2006 Korsunsky et al. ..... 439/65
2006/0276081 A1 * 12/2006 Cohen et al. ..... 439/608
2007/0149057 A1 * 6/2007 Cohen et al. ..... 439/608
2008/0233806 A1 * 9/2008 Rothermel et al. ..... 439/676

FOREIGN PATENT DOCUMENTS

JP 2005-522012 7/2005

* cited by examiner

*Primary Examiner*—T C Patel
*Assistant Examiner*—Vladimir Imas
(74) *Attorney, Agent, or Firm*—IPUSA, PLLC

(57) ABSTRACT

A connector has a housing, contact modules accommodated within the housing and having transmission path patterns with ends which form a plurality of contacts, and a connecting surface. Each of the contacts is exposed at the connecting surface. The contacts of each of the contact modules are aligned in a first direction, and corresponding contacts of the contact modules are aligned in a second direction perpendicular to the first direction, so that the contacts are disposed in a matrix arrangement. The lengths of adjacent transmission path patterns are identical within each of the contact modules but different among the contact modules.

19 Claims, 11 Drawing Sheets

CONNECTOR AND CONNECTOR DEVICE

BACKGROUND OF THE INVENTION

1. Field of the Invention

The present invention generally relates to connectors and connector devices, and more particularly to a connector capable of high-speed transmission and suited for use in electrically connecting a daughter board to a backplane of a communication equipment such as a server, and to a connector device having such a connector.

2. Description of the Related Art

A communication equipment, such as a server, includes a backplane (or backplane board), and a plurality of daughter boards that are arranged in parallel to each other and arranged perpendicularly to the backplane. The plurality of daughter boards are mutually connected via the backplane. Such a structure made up of the backplane and the plurality of daughter boards will hereinafter be referred to as a "printed circuit board combination".

A backplane connector is mounted at an end of the backplane, and daughter board connectors are mounted at ends of the daughter boards. The daughter boards are connected to the backplane by connecting the daughter board connectors to the backplane connector.

Recently, the signal transmission speed (or data rate) has increased considerably, and the balanced transmission technique is popularly used. The balanced transmission technique transmits a pair of positive and negative signals having the same magnitude with respect to a reference level, so that the signal to be transmitted is uneasily affected by noise. The connectors described above are also designed to enable such a signal transmission using the balanced transmission technique.

FIG. 1 is a perspective view generally showing an example of a conventional connector device. A connector device 10 shown in FIG. 1 is applied to a Printed Circuit Board (PCB) combination 1. FIG. 2 is a perspective view generally showing the connector device 10 shown in FIG. 1 in a state applied to the PCB combination 1.

A backplane 2 and a daughter board 3 shown in FIG. 2 are PCBs. The backplane 2 is located on an XY-plane, while the daughter board 3 is located on an XZ-plane.

A backplane connector 11 and a daughter board connector 21 shown in FIG. 1 both have right-angled transmission paths, as will be described later. The backplane connector 11 and the daughter board connector 21 in combination form the connector device 10. FIG. 1 shows the backplane connector 11 and the daughter board connector 21 in respective connecting positions. The height of the backplane connector 11 and the width of the daughter board connector 21 are taken along the direction Y. The width of the backplane connector 11 and the height of the daughter board connector 21 are taken along the direction Z.

The backplane connector 11 has four contact modules 12-1 through 12-4 which are arranged within a housing (not shown) with a shield plate (not shown) interposed between two adjacent contact modules. Each of the contact modules 12-1 through 12-4 has a main body 13 which is made of a synthetic resin and has a flat shape. Four right-angled transmission path patterns 14-1-1 through 14-1-4 are provided side by side on the main body 13. A male contact part 15 is provided on one end of each of the transmission path patterns 14-1-1 through 14-1-4, and a terminal member 16 is provided on the other end, that is, the base portion of each of the transmission path patterns 14-1-1 through 14-1-4. The male contact parts 15 are disposed in a matrix arrangement at a connecting surface 17 of the backplane connector 11. In each of the contact modules 12-1 through 12-4, the male contact parts 15 are aligned in the direction Y, that is, the direction in which the height of the backplane connector 11 is taken A more detailed description on the backplane connector 11 will be given later in the specification.

The daughter board connector 21 has a structure corresponding to the structure of the backplane connector 11. The daughter board connector 21 has a plurality of contact modules 22-1 through 22-4 which are arranged within a housing (not shown) with a shield plate (not shown) interposed between two adjacent contact modules 22. Each of the contact modules 22-1 through 22-4 has a main body 23 which is made of a synthetic resin and has a flat shape. Four right-angled transmission path patterns 24-1-1 through 24-1-4 are provided side by side on the main body 23. A female contact part 25 is provided on one end of each of the transmission path patterns 24-1-1 through 24-1-4, and a terminal member 26 is provided on the other end, that is, the base portion of each of the transmission path patterns 24-1-1 through 24-1-4. The female contact parts 25 are disposed in a matrix arrangement at a connecting surface 27 of the daughter board connector 21. In each of the contact modules 22-1 through 22-4, the female contact parts 25 are aligned in the direction Z.

As shown in FIG. 2, the terminal members 16 of the backplane connector 11 are mounted on the backplane 2, and the connecting surface 17 is provided at the end of the backplane 2. The terminal members 26 of the daughter board connector 21 are mounted on the daughter board 3, and the connecting surface 27 is provided at the end of the daughter board 3.

The connecting surface 27 of the daughter board connector 21 is made to confront the connecting surface 17 of the backplane connector 11, and the female contact members 25 are connected to the corresponding male contact parts 15, in order to connect the daughter board connector 21 to the backplane connector 11.

In the connector device 10, the contact modules 12-1 through 12-4 of the backplane connector 11 are located on the XY-plane, the contact modules 22-1 through 22-4 of the daughter board connector 21 are located on the XZ-plane, and the contact modules 12-1 through 12-4 of the backplane connector 11 are perpendicular to the contact modules 22-1 through 22-4 of the daughter board connector 21. In other words, each of the contact modules 12-1 through 12-4 of the backplane connector 11 intersects all of the contact modules 22-1 through 22-4 of the daughter board connector 21. Each of the contact modules 22-1 through 22-4 of the daughter board connector 21 intersects all of the contact modules 12-1 through 12-4 of the backplane connector 11.

The applicants are aware of a Japanese Patent Application Publication No. 2005-522012.

When a signal pair is transmitted from the backplane 2 to the daughter board 3 via the connector device 10, a pair of signals is transmitted via the following paths within the connector device 10.

As shown generally in FIG. 2, a pair of signals S1*a* and S1*b* from the back plane 2 towards the daughter board 3 is transmitted via a pair of adjacent transmission path patterns 14-1-1 and 14-1-2 of the contact module 12-1 of the backplane connector 11. The signal S1*a* transmitted via the transmission path pattern 14-1-1 is transmitted via the transmission path pattern 24-1-1 of the contact module 22-1 of the daughter board connector 21, and the signal S1*b* transmitted via the transmission path pattern 14-1-2 is transmitted via the transmission path pattern 24-2-1 of the contact module 22-2 of the daughter board connector 21.

Another pair of signals S2*a* and S2*b* from the back plane 2 towards the daughter board 3 is transmitted via another pair of adjacent transmission path patterns 14-1-3 and 14-1-4 of the contact module 12-1 of the backplane connector 11. The signal S2*a* transmitted via the transmission path pattern 14-1-3 is transmitted via the transmission path pattern of the contact module 22-3 of the daughter board connector 21, and the signal S2*b* transmitted via the transmission path pattern 14-1-4 is transmitted via the transmission path pattern of the contact module 22-4 of the daughter board connector 21.

Accordingly, the pair of signals transmitted via the pair of adjacent transmission path patterns of one contact module of the backplane connector is transmitted via the pair of adjacent transmission path patterns of two different contact modules of the daughter board connector.

The pair of signals have waveforms that are closely related to each other, and it is important to maintain this relationship in order to maintain a satisfactory signal transmission characteristic. But when the pair of signals is transmitted via the transmission path patterns of different contact modules within the connector device, the length of the transmission path becomes different for the pair of signals, and the relationship described above cannot be maintained. In addition, the deterioration of the signal transmission characteristic becomes more notable as the signal transmission speed becomes higher.

SUMMARY OF THE INVENTION

Accordingly, it is a general object of the present invention to provide a novel and useful connector and connector device, in which the problems described above are suppressed.

Another and more specific object of the present invention is to provide a connector and a connector device which can maintain a satisfactory signal transmission characteristic.

According to one aspect of the present invention, there is provided a connector comprising a housing; a plurality of contact modules accommodated within the housing, each of the plurality of contact modules having a plurality of transmission path patterns having ends which form a plurality of contacts; and a connecting surface, each of the plurality of contacts being exposed at the connecting surface, wherein the contacts of each of the plurality of contact modules are aligned in a first direction, and corresponding contacts of the plurality of contact modules are aligned in a second direction perpendicular to the first direction, so that the contacts are disposed in a matrix arrangement, and lengths of adjacent transmission path patterns are identical within each of the plurality of contact modules but different among the plurality of contact modules.

According to one aspect of the present invention, there is provided a connector device comprising a first connector having a plurality of first contacts which are exposed at a first connecting surface and are disposed in a matrix arrangement; and a second connector having a second connecting surface to be connected to the first connecting surface, the second connector comprising a housing; and a plurality of contact modules accommodated within the housing, wherein each of the plurality of contact modules has a plurality of transmission path patterns having ends which form a plurality of second contacts, each of the plurality of second contacts is exposed at the connecting surface and connects to a corresponding one of the first contacts of the first connector, the second contacts of each of the plurality of contact modules are aligned in a first direction, and corresponding second contacts of the plurality of contact modules are aligned in a second direction perpendicular to the first direction, so that the second contacts are disposed in a matrix arrangement, and lengths of adjacent transmission path patterns are identical within each of the plurality of contact modules but different among the plurality of contact modules.

According to one aspect of the present invention, there is provided a printed circuit board combination comprising a first board; a second board; a first connector, mounted on the first board, and having a plurality of first contacts which are exposed at a first connecting surface and are disposed in a matrix arrangement; and a second connector, mounted on the second board, and having a second connecting surface to be connected to the first connecting surface, the second connector comprising a housing; and a plurality of contact modules accommodated within the housing, wherein each of the plurality of contact modules has a plurality of transmission path patterns having ends which form a plurality of second contacts, each of the plurality of second contacts is exposed at the connecting surface and connects to a corresponding one of the first contacts of the first connector, the second contacts of each of the plurality of contact modules are aligned in a first direction, and corresponding second contacts of the plurality of contact modules are aligned in a second direction perpendicular to the first direction, so that the second contacts are disposed in a matrix arrangement, and lengths of adjacent transmission path patterns are identical within each of the plurality of contact modules but different among the plurality of contact modules.

Other objects and further features of the present invention will be apparent from the following detailed description when read in conjunction with the accompanying drawings.

DESCRIPTION OF THE PREFERRED EMBODIMENTS

First Embodiment

Figure 1:
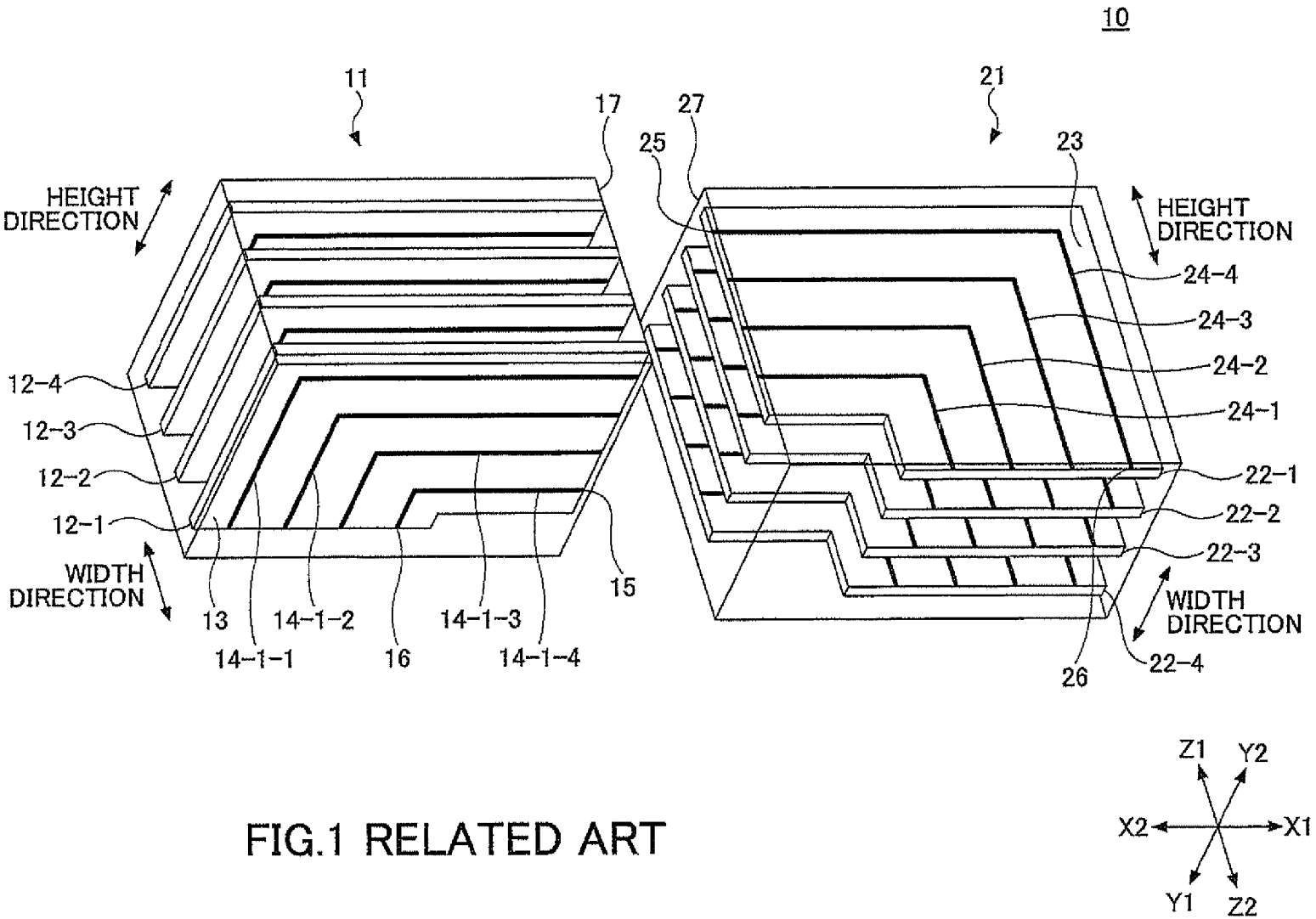
FIG.1 RELATED ART
FIG. 1 is a perspective view generally showing an example of a conventional connector device.
Figure 2:
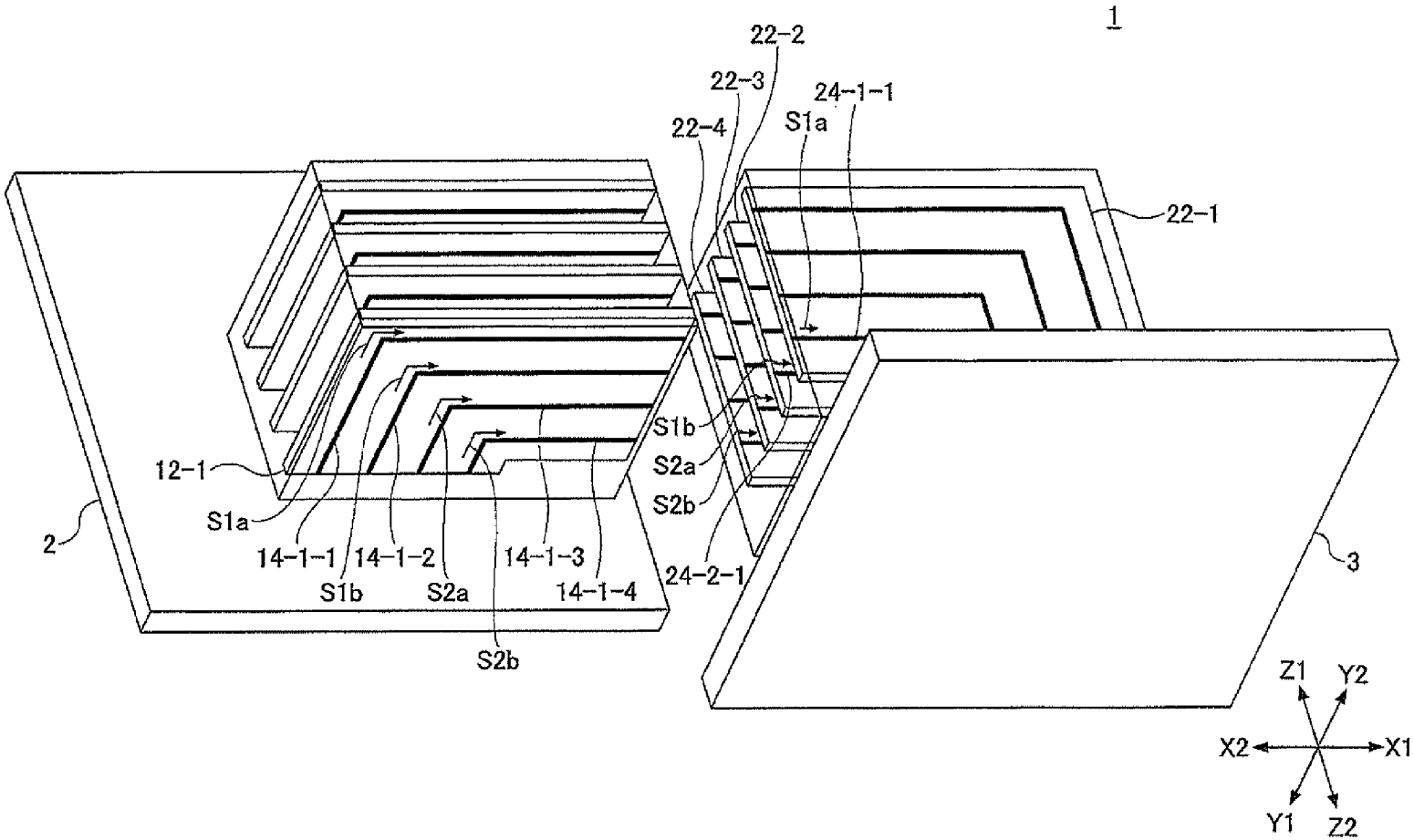
FIG.2 RELATED ART
FIG. 2 is a perspective view generally showing the connector device shown in FIG. 1 in a state applied to a PCB combination.
Figure 3:
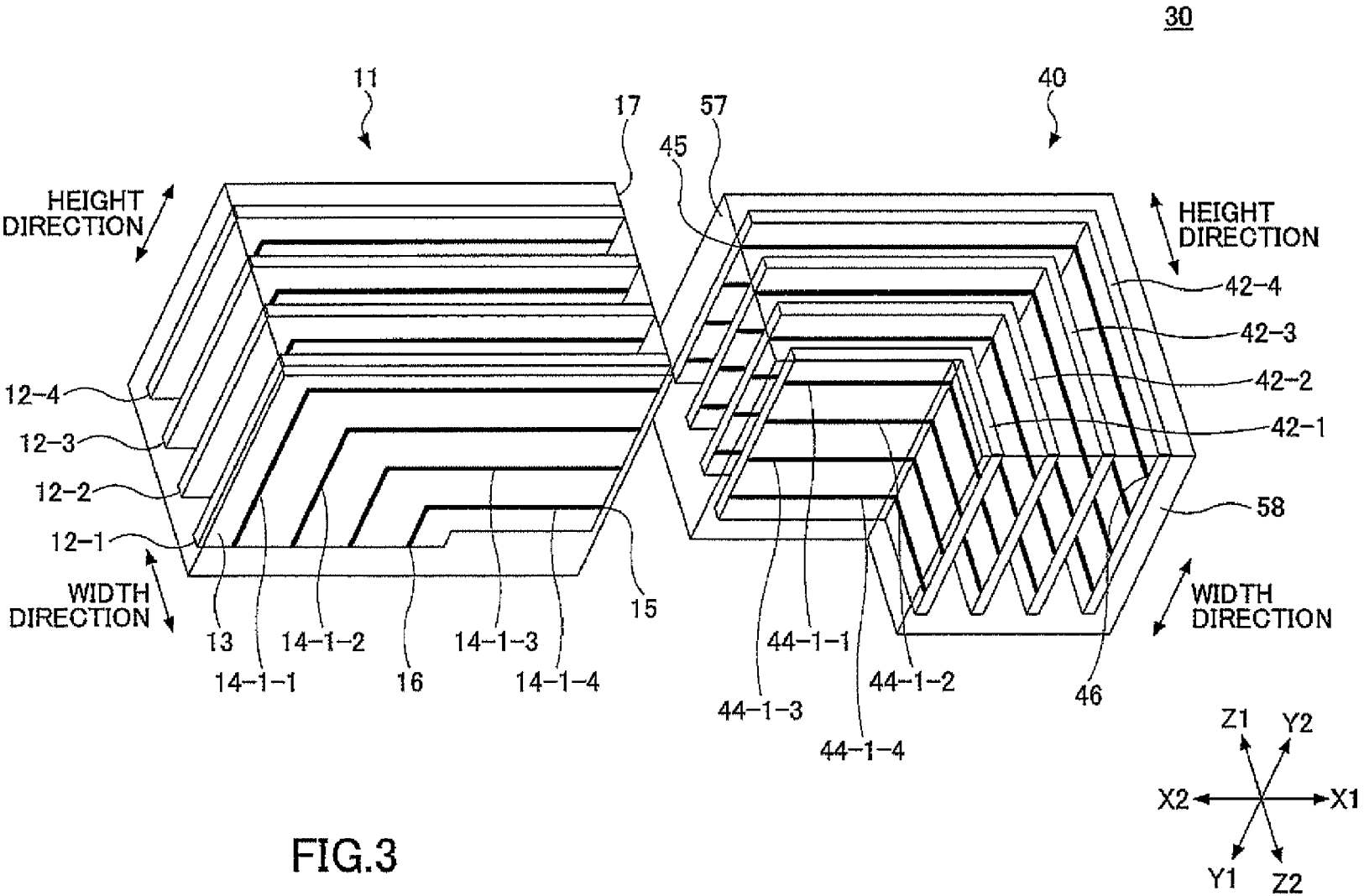
FIG. 3 is a perspective view generally showing a connector device in a first embodiment of the present invention.
Figure 4:
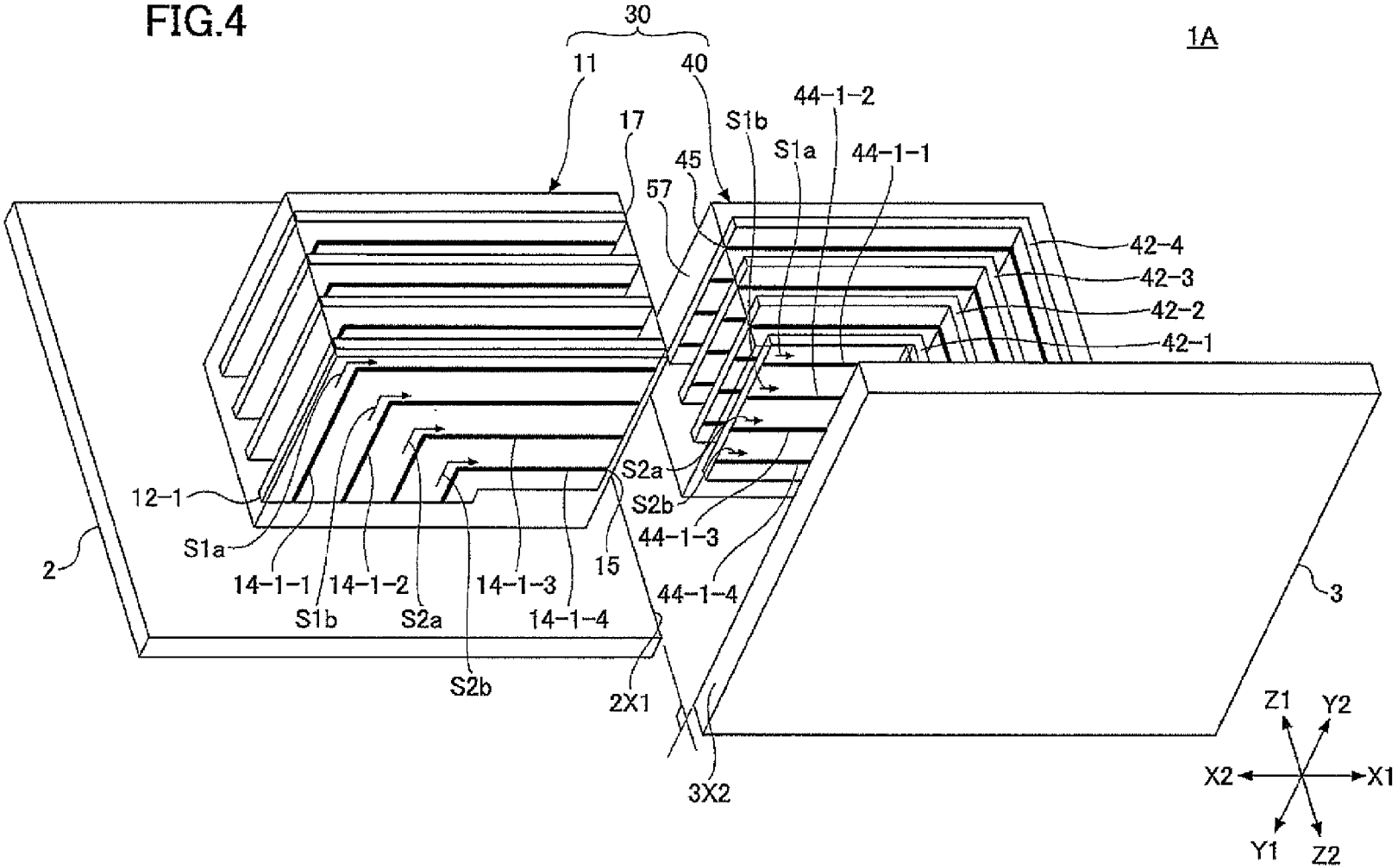
FIG. 4 is a perspective view generally showing the connector device shown in FIG. 3 in a state applied to a PCB combination.

FIG. 3 is a perspective view generally showing a connector device 30 in a first embodiment of the present invention. FIG. 4 is a perspective view generally showing the connector device 30 shown in FIG. 3 in a state applied to a PCB combination 1A. In FIGS. 3 and 4, those parts that are the same as those corresponding parts in FIGS. 1 and 2 are designated by the same reference numerals, and a description thereof will be omitted.

The connector device 30 includes a backplane connector 11 and a daughter board connector 40. The connector device 30 differs from the conventional connector device 1 shown in FIGS. 1 and 2, in that the daughter board connector 40 is provided in place of the daughter board connector 21.

The daughter board connector 40 has a right-angled structure. FIGS. 3 and 4 show the backplane connector 11 and the daughter board connector 40 in respective connecting positions. The height of the backplane connector 11 and the width of the daughter board connector 40 are taken along the direction Y. The width of the backplane connector 11 and the height of the daughter board connector 40 are taken along the direction Z.

A Printed Circuit Board (PCB) combination 1A includes a backplane (or backplane board) 2, a daughter board 3, and a connector device 30. The backplane 2 and the daughter board 3 are arranged so that one end edge 3X2 of the daughter board 3 is perpendicular to one edge 2X1 of the backplane 2.

[Structure of Backplane Connector 11]

Figure 5:
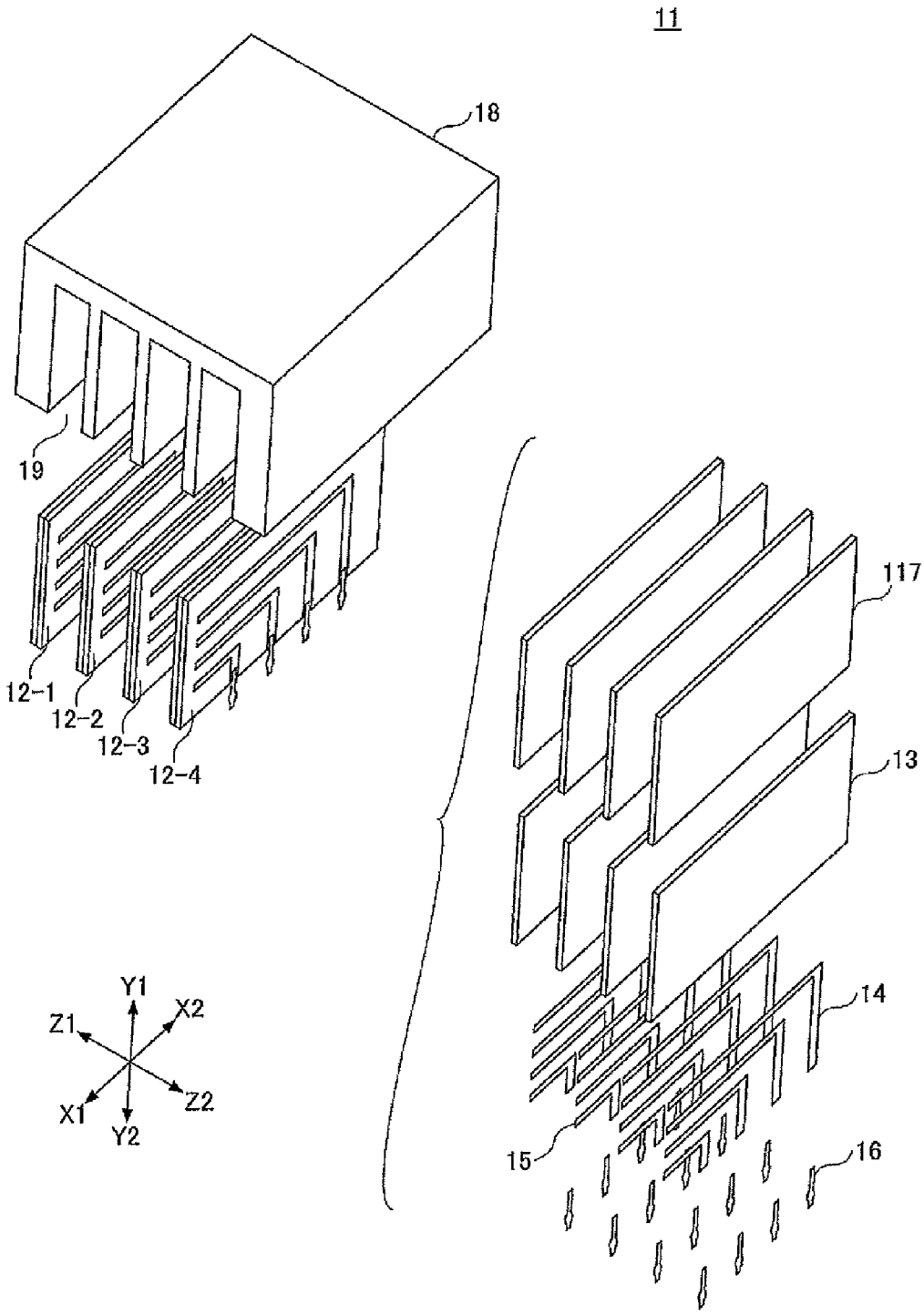
FIG. 5 is a disassembled perspective view showing a backplane connector.

FIG. 5 is a disassembled perspective view showing the backplane connector 11.

As shown in FIGS. 3 and 5, each of contact modules 12-1 through 12-4 has a main body 13 which is made of an insulator material and has a plate shape. Four right-angled transmission path patterns (or transmission path members) 14-1-1 through 14-1-4 are provided side by side on one surface of the main body 13. The transmission path patterns 14-1-1 through 14-1-4 are indicated by a reference numeral 14 in FIG. 5. A male contact part 15 is provided on one end of each of the transmission path patterns 14-1-1 through 14-1-4, and a terminal member 16 is provided on the other end, that is, the base portion of each of the transmission path patterns 14-1-1 through 14-1-4. A shield member 117 having a plate shape is provided on the other surface of each main body 13 as shown in FIG. 5.

A housing 18 is molded from a synthetic resin, and has four slits 19 that are formed side by side. The contact modules 12-1 through 12-4 are assembled within the housing 18 by being inserted into the four slits 19.

Otherwise, the backplane connector 11 has the same structure as that shown in FIGS. 1 and 2.

In each of the contact modules 12-1 through 12-4, the male contact parts 15 are aligned in the direction Y, that is, the direction in which the height of the backplane connector 11 is taken. Among the contact modules 12-1 through 12-4, the corresponding male contact parts 15 are arranged along imaginary lines (or rows) that are parallel to the direction in which the width of the backplane connector 11 is taken.

[Structure of Daughter Board Connector 40]

Figure 6:
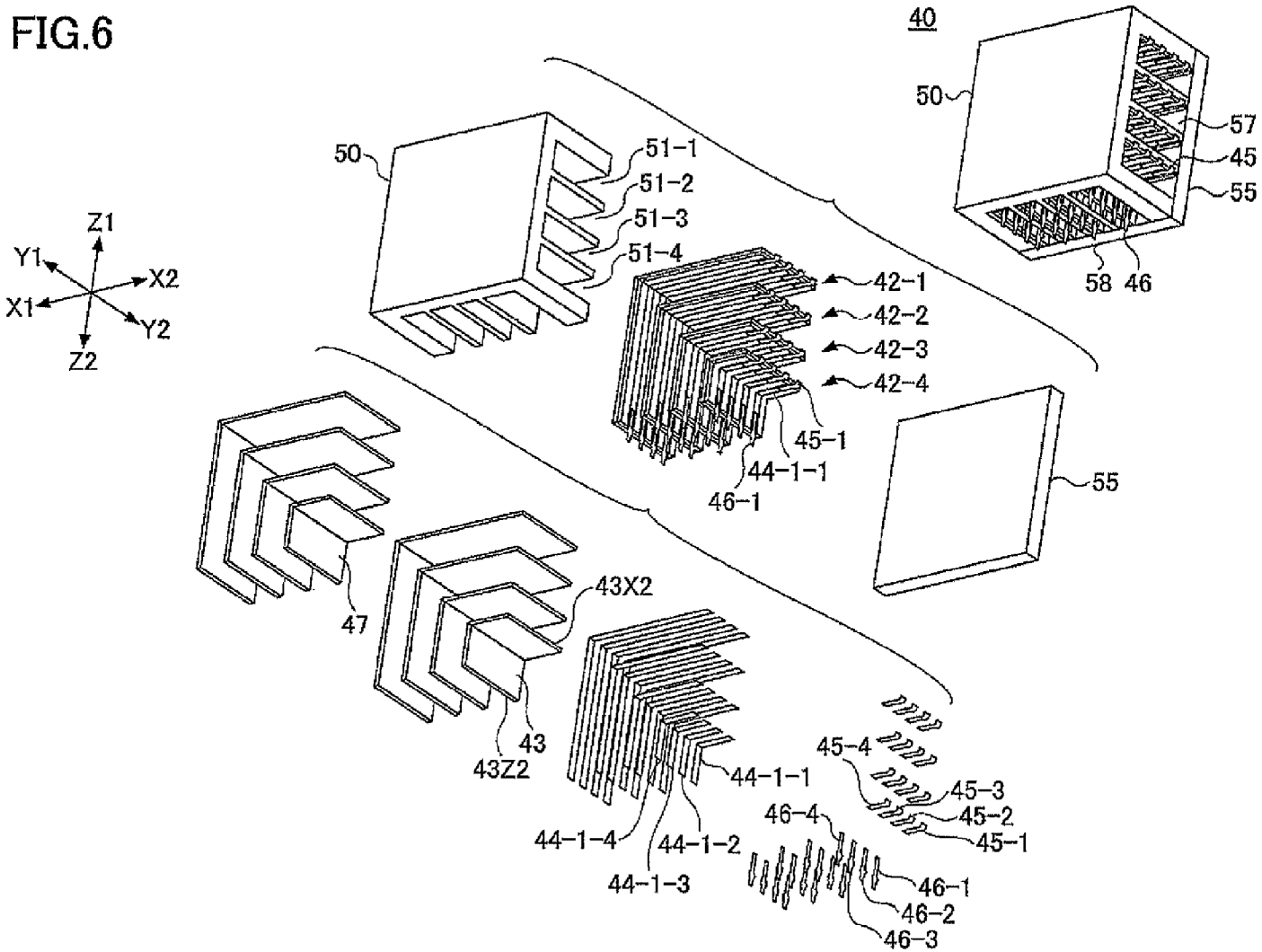
FIG. 6 is a disassembled perspective view showing a daughter board connector viewed in a direction Y2.
Figure 7:
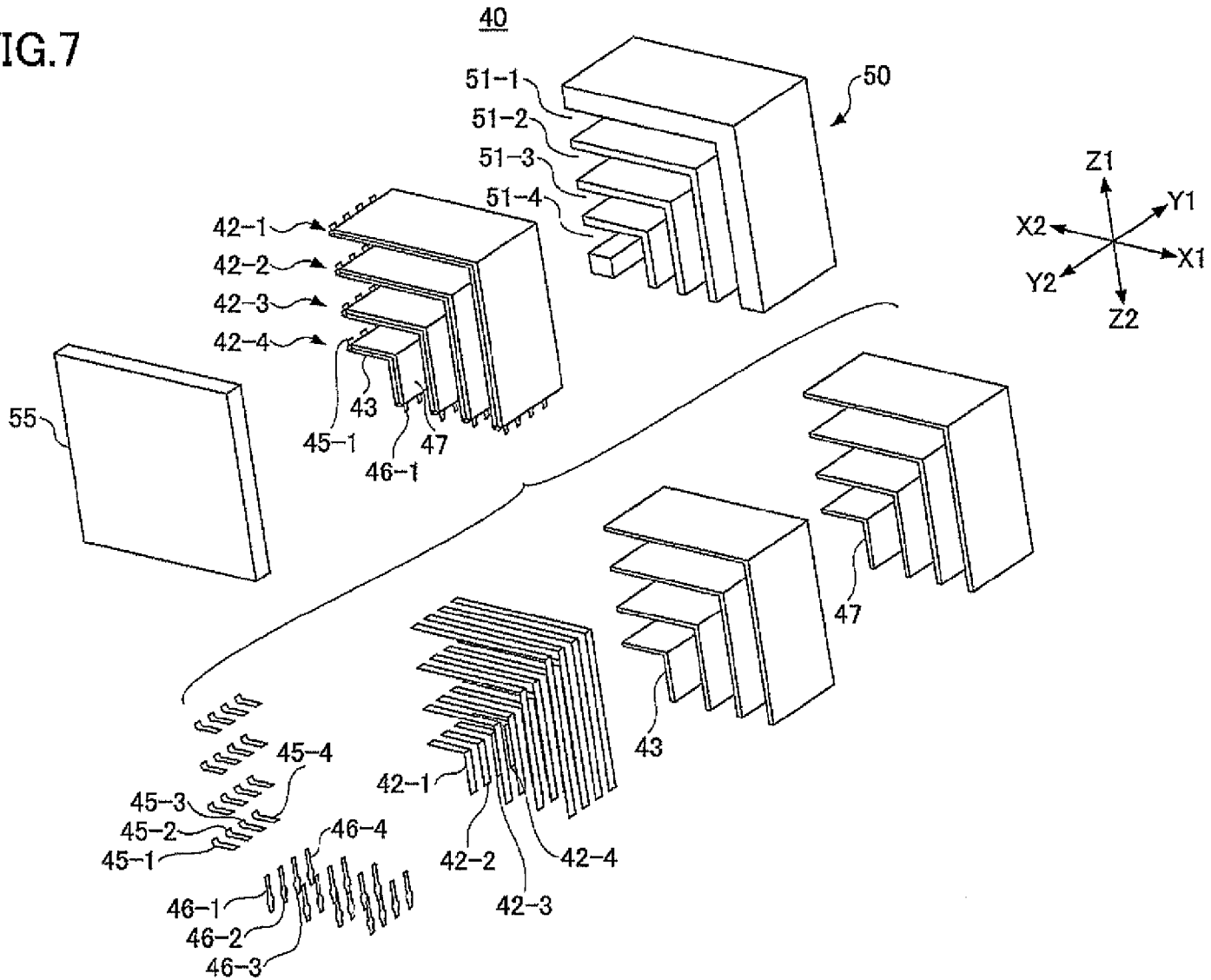
FIG. 7 is a disassembled perspective view showing the daughter board connector viewed in a direction Y1.

FIG. 6 is a disassembled perspective view showing the daughter board connector 40 viewed in a direction Y2. FIG. 7 is a disassembled perspective view showing the daughter board connector 40 viewed in a direction Y1.

As shown in FIGS. 3, 6 and 7, the daughter board connector 40 includes contact modules 42-1 through 42-4, a housing 50, and a cover 55. The contact modules 42-1 through 42-4 are assembled within the housing 50, and the cover 55 is provided on the housing 50.

Each of the contact modules 42-1 through 42-4 includes a main body 43, four transmission path patterns (or transmission path members) 44-1-1 through 44-1-4, female contact members 45-1 through 45-4 which are used as contacts, terminal members 46-1 through 46-4, and shield members 47, as shown in FIG. 6. The female contact members 45-1 through 45-4 are indicated by a reference numeral 45 in FIGS. 3 and 4, and the terminal members 46-1 through 46-4 are indicated by a reference numeral in FIG. 3. The main body 43 is made of an insulator material, and has an elongated plate shape which is bent in an approximate L-shape.

The transmission path patterns 44-1-1 through 44-1-4 are arranged side by side, in parallel to each other, on an inner surface of each main body 43. The transmission path patterns 44-1-1 through 44-1-4 extend from an end 43X2 in a direction X2 to an end 43Z2 in a direction Z2.

The female contact members 45-1 through 45-4 are fixed at an end 43X2 in the direction X2 of the main body 43, in a state electrically connected to the corresponding transmission path patterns 44-1-1 through 44-1-4, and are arranged along the end 43X2 in the direction Y.

Terminal members 46-1 through 46-4 are fixed at an end 43Z2 in a direction Z2 of the main body 43, in a state electrically connected to the corresponding transmission path patterns 44-1-1 through 44-1-4. The terminal members 46-1 through 46-4 project from the end 43Z2 in the direction Z2, and are arranged along the end 43Z2 in the direction Y.

Each of the shield members 47 is made of a suitable shielding material, and has an elongated plate shape which is bent in an approximate L-shape, similarly to the main body 43. The shield member 47 is provided on an outer surface of the corresponding main body 43, and totally covers the outer surface of the corresponding main body 43.

The contact module 42-2 has a size slightly larger than that of the contact module 42-1, but the structure of the contact module 42-2 is the same as that of the contact module 42-1. The contact module 42-3 has a size slightly larger than that of the contact module 42-2, but the structure of the contact module 42-3 is the same as that of the contact module 42-1. The contact module 42-4 has a size slightly larger than that of the contact module 42-3, but the structure of the contact module 42-4 is the same as that of the contact module 42-1.

The contact modules 42-1 through 42-4 have sizes that become slightly larger from the bottom contact module 42-1 towards the top contact module 42-4. The contact modules 42-1 through 42-4 are overlapped so that the corresponding two ends of the L-shape thereof match.

The housing 50 is molded from a synthetic resin, and has a size corresponding to the four contact modules 42-1 through 42-4 as shown in FIGS. 6 and 7. The housing 50 has four L-shaped slits 51-1 through 51-4 that are arranged side by side for receiving the four contact modules 42-1 through 42-4. The cover 55 has a rectangular plate shape with a size that covers one surface of the housing 50.

The contact modules 42-1 through 42-4 of the daughter board connector 40 are assembled within the corresponding slits 51-1 through 51-4 of the housing 50, and the daughter board connector 40 is covered by the cover 55. The contact modules 42-1 through 42-4 are independently accommodated within the corresponding slits 51-1 through 51-4.

As shown in FIG. 3, the female contact members 45-1 through 45-4 (indicated by the reference numeral 45) are disposed in a matrix arrangement at a connecting surface 57 which is located on the YZ-plane. The terminal members 46-1 through 46-4 (indicated by the reference numeral 46) are disposed in a matrix arrangement at a mounting surface 58 which is located on the XY-plane. The connecting surface 57 and the mounting surface 58 are in a perpendicular positional relationship.

At the connecting surface 57, the female contact members 45 of the same contact module 42 are aligned in a column in the direction Y, that is, in the direction in which width of the daughter board connector 40 is taken. Four such rows of the frame contact members 45 are arranged in parallel along the direction Z, that is, in the direction in which the height of the daughter board connector 40 is taken. The direction in which the female contact members 45 of the same contact module 42 are aligned is the same as the direction in which the male contact parts 15 of the same contact module 12 of the backplane connector 11 are aligned.

At the mounting surface 58, the terminal members 46 of the same contact module 42 are aligned in a column in the direction Y, and four such columns of the terminal members 46 are arranged in parallel along the direction X.

[Connection of Backplane Connector 11 and Daughter Board Connector 40, and Pair Signal Transmission Path]

As shown in FIG. 4, the backplane connector 11 is mounted on the backplane 2 by fixing thereon the terminal members 16 shown in FIG. 3. In this state, the connecting surface 17 is exposed at one end (right end in FIG. 4) of the backplane 2. The daughter board connector 40 is mounted on the daughter board 3 by fixing thereon the terminal members 46 shown in FIG. 3. In this state, the connecting surface 57 is exposed at one end (left end in FIG. 4) of the daughter board 3.

The daughter board connector 40 is connected to the backplane connector 11 by making the connecting surface 47 of the daughter board connector 40 confront the connecting surface 17 of the backplane connector 11, and connecting the female contact members 45 to the corresponding male contact parts 15.

The female contact members 45 which are aligned along the end of the same contact module 42 of the daughter board connector 40 connect to the corresponding male contact parts 15 which are aligned along the end of the same contact module 12 of the backplane connector 11. Accordingly, the signal transmission path within the connector device 30 when the pair of signals is transmitted from the backplane 2 to the daughter board 3 via the connector device 30, becomes as follows.

As shown in FIG. 4, the pair of signals S1*a* and S1*b* transmitted from the backplane 2 to the daughter board 3 is transmitted via the pair of adjacent transmission path patterns 14-1-1 and 14-1-2 of the same contact module 12-1 in the backplane connector 11. The signal S1*a* transmitted via the transmission path pattern 14-1-1 is transmitted via the transmission path pattern 44-1-1 of the contact module 42-1 in the daughter board connector 40, and the signal S1*b* transmitted via the transmission path pattern 14-1-2 is transmitted via the transmission path pattern 44-1-2 of the same contact module 42-1 in the daughter board connector 40. The adjacent transmission path patterns 44-1-1 and 44-1-2 of the same contact module 42-1 form a pair corresponding to the pair of adjacent transmission path patterns 14-1-1 and 14-1-2 of the same contact module 12-1 in the backplane connector 11.

Another pair of signals S2*a* and S2*b* is transmitted via another pair of adjacent transmission path patterns 14-1-3 and 14-1-4 of the same contact module 12-1 in the backplane connector 11, and is further transmitted via another pair of adjacent transmission path patterns 44-1-3 and 44-1-4 of the same contact module 42-1 in the daughter board connector 40.

Therefore, all pairs of signals transmitted via all pairs of transmission path patterns within the same contact module 12-1 in the backplane connector 11 are transmitted via the corresponding pairs of transmission path patterns within the same contact module 42-1 in the daughter board connector 40.

Similarly, all pairs of signals transmitted via all pairs of transmission path patterns within the same contact module 12-2 in the backplane connector 11 are transmitted via the corresponding pairs of transmission path patterns within the same contact module 42-2 in the daughter board connector 40. In addition, all pairs of signals transmitted via all pairs of transmission path patterns within the same contact module 12-3 in the backplane connector 11 are transmitted via the corresponding pairs of transmission path patterns within the same contact module 42-3 in the daughter board connector 40. Moreover, all pairs of signals transmitted via all pairs of transmission path patterns within the same contact module 12-4 in the backplane connector 11 are transmitted via the corresponding pairs of transmission path patterns within the same contact module 42-4 in the daughter board connector 40.

Accordingly, each pair of signals transmitted within one of the contact modules 12-1 through 12-4 in the backplane connector 11 is transmitted within the corresponding one of the contact modules 42-1 through 42-4 in the daughter board connector 40, without being separated and transmitted via separate contact modules of the daughter board connector 40. For this reason, each pair of signals transmitted via the adjacent transmission path patterns of one of the contact modules 12-1 through 12-4 in the backplane connector 11 is transmitted via the adjacent transmission path patterns of the corresponding one of the contact modules 42-1 through 42-4 in the daughter board connector 40.

Furthermore, the lengths of the adjacent transmission path patterns of the same contact module 42 are identical, as may be seen from FIG. 3. The pair of signals have waveforms that are closely related to each other, and it is important to maintain this relationship in order to maintain a satisfactory signal transmission characteristic. In this embodiment, the pair of signals is transmitted via the adjacent transmission path patterns of the same contact module 42 within the daughter board connector 40, and the length of the adjacent transmission paths are the same for the pair of signals. Hence, no delay or shift is introduced between the pair of signals transmitted via the adjacent transmission path patterns of the same contact module 42, and the relationship described above can be maintained in a satisfactory manner. In addition, the deterioration of the signal transmission characteristic does not become notable even when the signal transmission speed is high. In other words, the signal transmission characteristic in the transmission paths within the connector device 30 is improved compared to the conventional connector device 10 shown in FIG. 1, for example.

Of course, the backplane connector 11 may be mounted on the daughter board 3, and in this case, the daughter board connector 40 may be mounted on the backplane 2.

Second Embodiment

Figure 8:
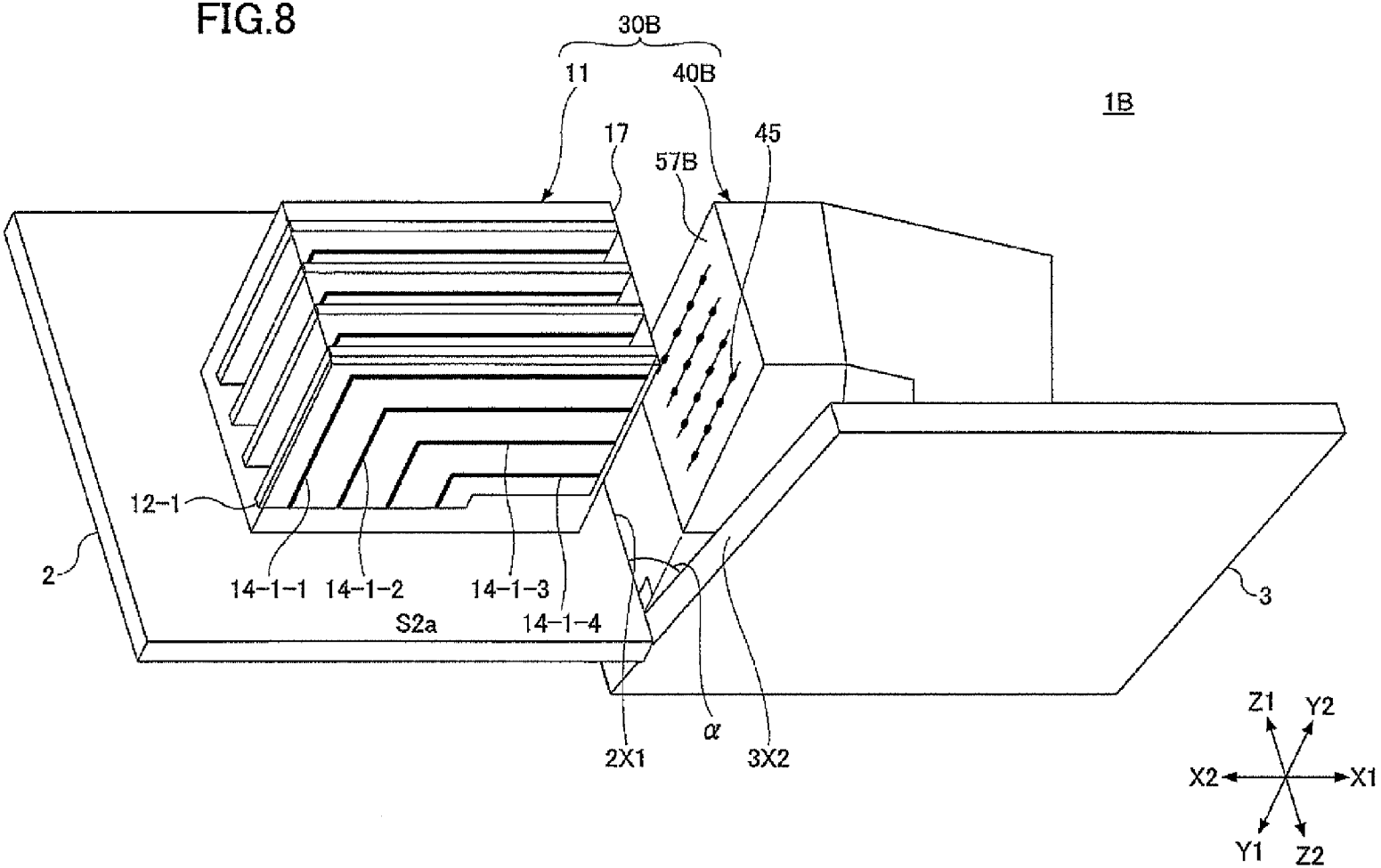
FIG. 8 is a perspective view generally showing a connector device in a second embodiment of the present invention.

FIG. 8 is a perspective view generally showing a connector device in a second embodiment of the present invention. In FIG. 8, those part that are the same as those corresponding parts in FIGS. 3 and 4 are designated by the same reference numerals, and a description thereof will be omitted.

As shown in FIG. 8, a PCB combination 1B including a backplane 2, a daughter board 3, and a connector device 30B. The backplane 2 and the daughter board 3 are arranged so that one edge 3X2 of the daughter board 3 and one edge 2X1 of the backplane 2 intersect at an obtuse angle $\alpha$.

Figure 9A:
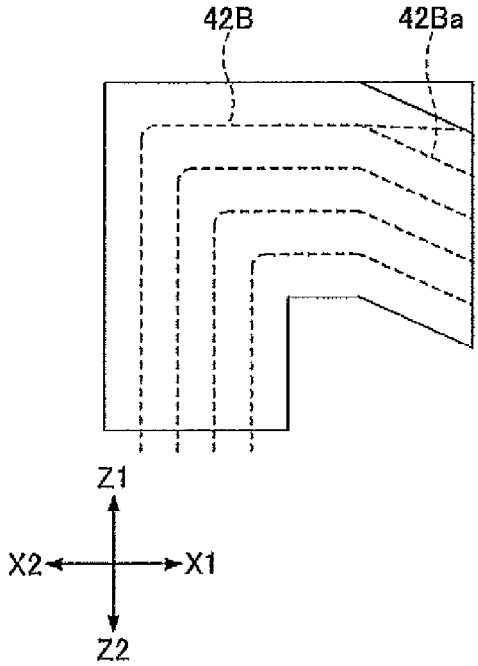
FIG. 9A through 9C are diagrams showing the daughter board connector shown in FIG. 8.
Figure 9B:
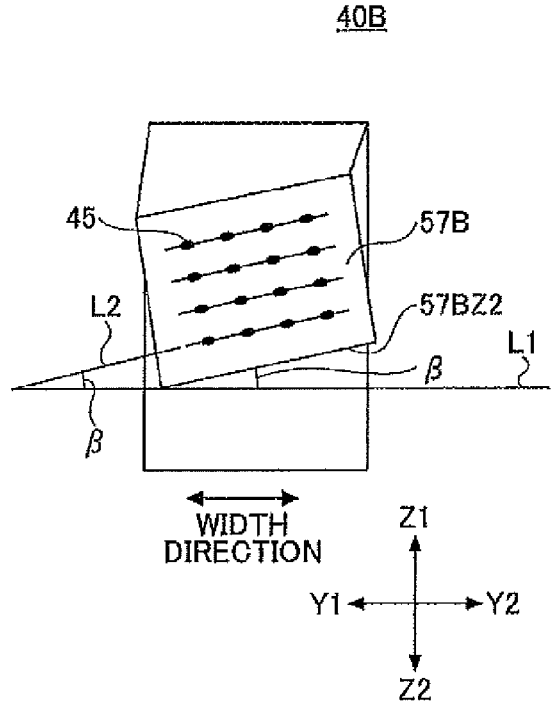
Figure 9C:
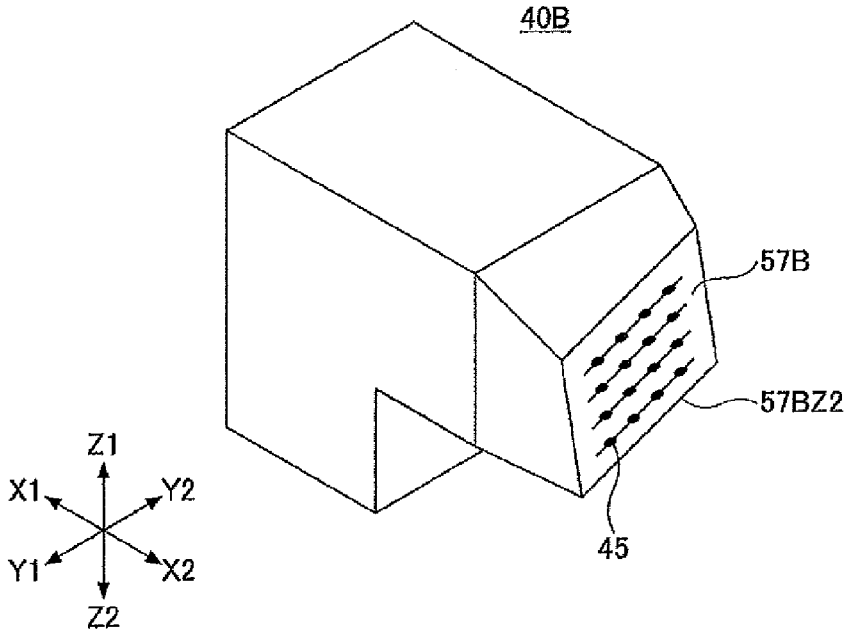

The connector device 30B includes a backplane connector 11, and a daughter board connector 40B shown in FIGS. 9A through 9C. FIG. 9A through 9C are diagrams showing the daughter board connector 40B shown in FIG. 8. FIGS. 9A, 9B and 9C respectively are a plan view, a side view and a perspective view of the daughter board connector 40B.

Compared to the daughter board connector 40 shown in FIGS. 3, 6 and 7, the daughter board connector 40B has a connecting surface 57B which is rotated counterclockwise by an angle β in FIG. 9B with respect to the connecting surface 57 of the daughter board connector 40, while maintaining the rectangular shape of the connecting surface 47B.

A contact module 42B has an elongated plate shape which is bent in an approximate L-shape, with a slightly twisted shape in a vicinity 42Ba of an end of the contact module 42B in the direction X2, as shown in FIG. 9A.

A plurality of female contact members 45 at the end of the contact module 42B in the direction X2 are arranged parallel to a side 57BZ2 in the direction Z2 of the rectangular shape of the connecting surface 57B. In addition, the plurality of female contact members 45 are arranged along a line L2 which is inclined by the obtuse angle β with respect to a line L1 in the direction in which the width of the connector device 30B is taken.

The daughter board connector 40B is suited for use in a case where the positional relationship of the daughter board 3 and the backplane 2 is shifted from the mutually perpendicular arrangement.

Third Embodiment

Figure 10:
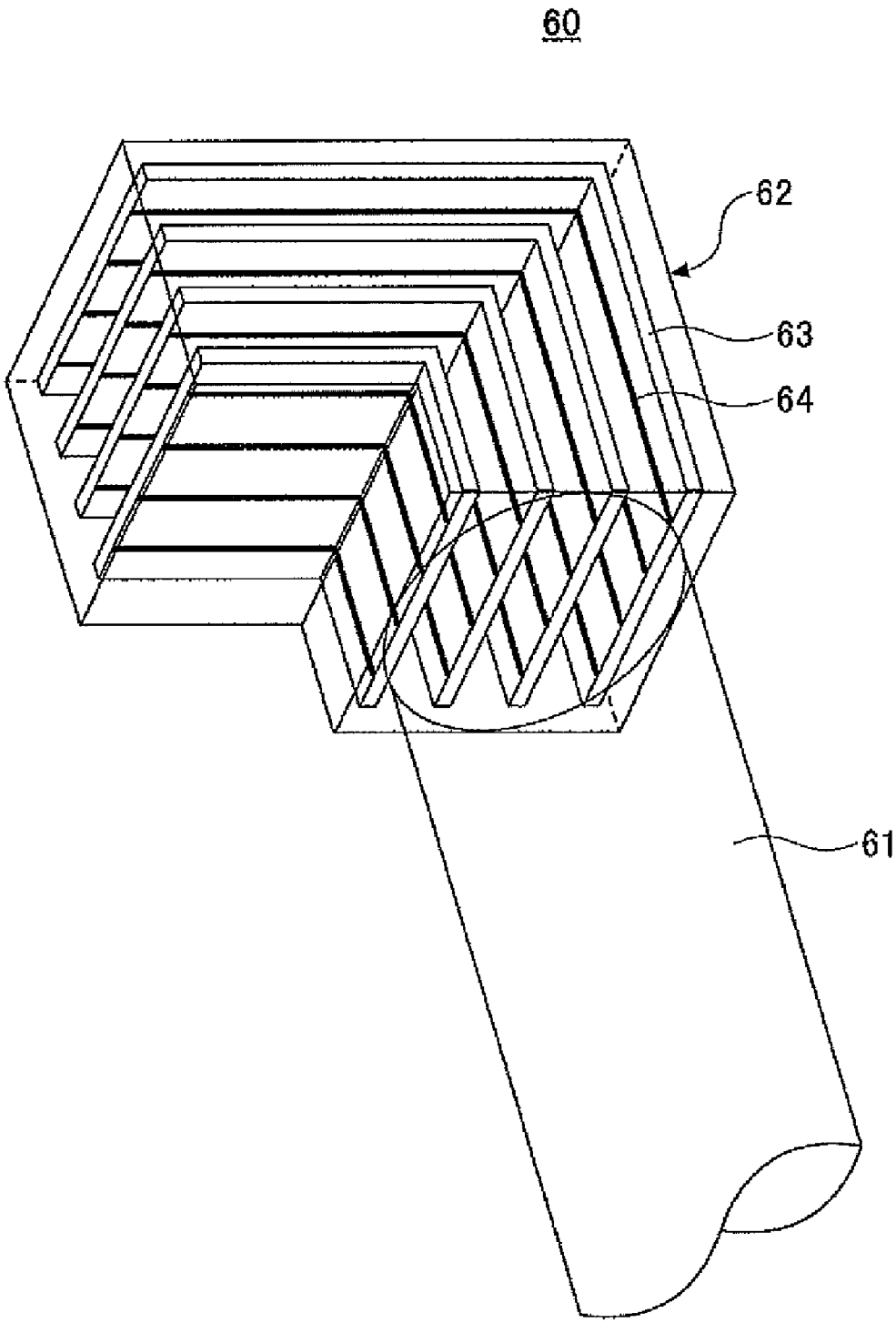
FIG. 10 is a perspective view showing a cable connector in a third embodiment of the present invention.

FIG. 10 is a perspective view showing a cable connector in a third embodiment of the present invention.

A cable connector 60 shown in FIG. 10 includes a cable 61, and a connector 62 which is provided on an end of the cable 61. This connector 62 has a structure that is approximately the same as that of the daughter board connector 40 of the first embodiment. An end of each wire within the cable 61 is connected to an end of a corresponding transmission path pattern 64 of a corresponding contact module 63.

[Modification]

Figure 11:
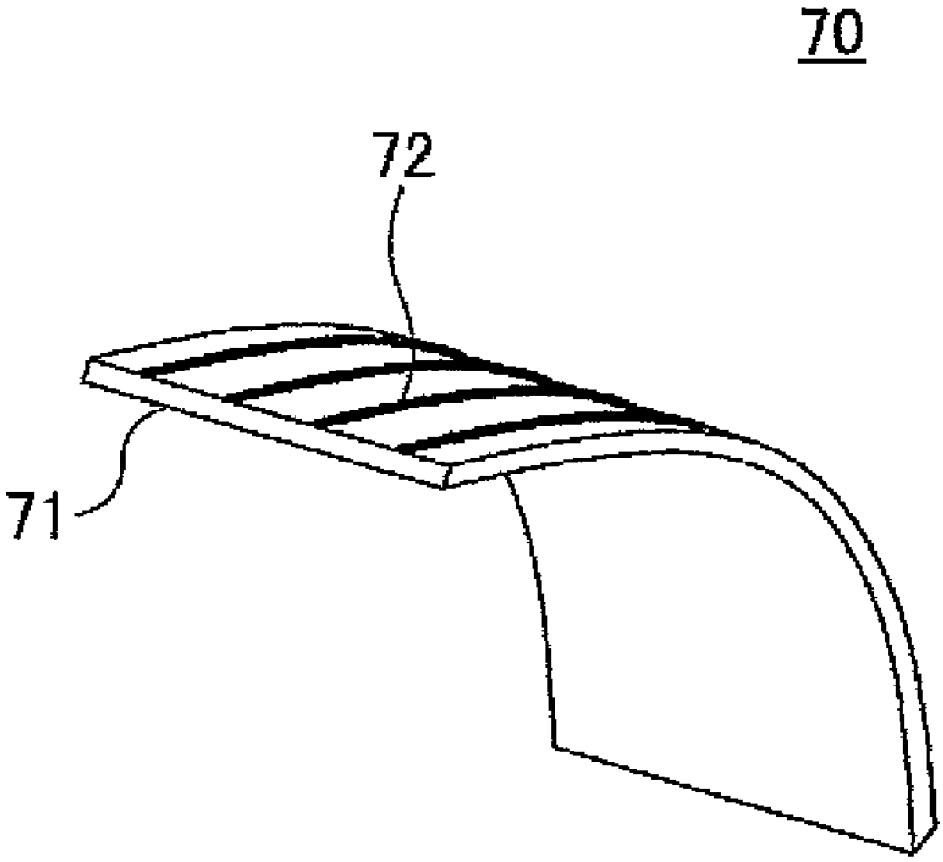
FIG. 11 is a perspective view showing a contact module in a modification of the present invention.

FIG. 11 is a perspective view showing a contact module in a modification of the present invention. The contact modules 42-1 through 42-4 simply need to haven an approximate L-shape. Hence, it is possible to use a Flexible Printed Circuit (FPC) for the contact modules 42-1 through 42-4. A contact module 70 shown in FIG. 11 has a FPC base 71, and a wiring pattern 72 which forms the transmission path patterns.

The contact module 70 is suited for use as the contact module 42B shown in FIG. 9A which is twisted in addition to being bent in the approximate L-shape.

Of course, the contact module 42 described above may be formed by inserting, in a synthetic resin, an elongated member which integrally has the female contact parts, the transmission path patterns and the terminal parts, and forming a shield member on one surface of the synthetic resin.

This application claims the benefit of a Japanese Patent Application No. 2008-061688 filed Mar. 11, 2008, in the Japanese Patent Office, the disclosure of which is hereby incorporated by reference.

Further, the present invention is not limited to these embodiments, but various variations and modifications may be made without departing from the scope of the present invention.

What is claimed is:

1. A connector device comprising:

a first connector comprising a plurality of first contact modules each having a plurality of first transmission path patterns having first ends which form a plurality of first contacts which are exposed at a first connecting surface and are disposed in a matrix arrangement; and a second connector comprising a plurality of second contact modules each having a plurality of second transmission path patterns having second ends which form a plurality of second contacts which are exposed at a second connecting surface to be connected to the first connecting surface, wherein each of the plurality of second contacts couples to a corresponding one of the first contacts of the first connector, the second contacts of each of the plurality of second contact modules are aligned in a first direction, and corresponding second contacts of the plurality of second contact modules are aligned in a second direction perpendicular to the first direction, so that the second contacts are disposed in a matrix arrangement, lengths of adjacent second transmission path patterns are identical within each of the plurality of second contact modules but different among the plurality of second contact modules, and the first contact modules in a vicinity of the first connecting surface are arranged parallel to each other and the second contact modules in a vicinity of the second connecting surface are arranged parallel to each other so that the first contact modules in the vicinity of the first connecting surface are parallel to the second contact modules in the vicinity of the second connecting surface.

2. The connector device as claimed in claim 1, wherein the second connector further comprises:

a mounting surface which is fixed on a board when mounting the second connector on the board, wherein the mounting surface is parallel to the second direction.

3. The connector device as claimed in claim 1, wherein the second connector further comprises a housing configured to accommodate the plurality of second contact modules.

4. The connector device as claimed in claim 1, wherein the second connector further comprises:

a mounting surface which is fixed on a board when mounting the second connector on the board, wherein the mounting surface is inclined with respect to the second direction.

5. The connector device as claimed in claim 4, wherein each of the plurality of second contact modules has an approximate L-shape with a twisted portion in a vicinity of the ends of the second transmission path patterns.

6. The connector device as claimed in claim 1, wherein the plurality of second contact modules have approximate L-shapes of mutually different sizes.

7. The connector device as claimed in claim 6, wherein the second connector further comprises:

a shield member interposed between two adjacent second contact modules.

8. The connector device as claimed in claim 1, wherein the plurality of second transmission path patterns have third ends opposite the second ends, and the third ends are coupled to a cable.

9. The connector device as claimed in claim 1, wherein each of the plurality of second contact modules has an approximate L-shape.

10. The connector device as claimed in claim 9, wherein each of the plurality of first contact modules has a plurality of right-angled transmission path patterns.

11. A printed circuit board combination comprising:

a first board;

a second board;

a first connector, mounted on the first hoard, and having comprising a plurality of first contact modules each having a plurality of first transmission path patterns having first ends which form a plurality of first contacts which are exposed at a first connecting surface and are disposed in a matrix arrangement; and a second connector, mounted on the second board, and comprising a plurality of second contact modules each having a plurality of second transmission path patterns having second ends which form a plurality of second contacts which are exposed at a second connecting surface to be connected to the first connecting surface, wherein each of the plurality of second contacts couples to a corresponding one of the first contacts of the first connector, the second contacts of each of the plurality of second contact modules are aligned in a first direction, and corresponding second contacts of the plurality of second contact modules are aligned in a second direction perpendicular to the first direction, so that the second contacts are disposed in a matrix arrangement, lengths of adjacent second transmission path patterns are identical within each of the plurality of second contact modules but different among the plurality of second contact modules, and the first contact modules in a vicinity of the first connecting surface are arranged parallel to each other and the second contact modules in a vicinity of the second connecting surface are arranged parallel to each other so that the first contact modules in the vicinity of the first connecting surface are parallel to the second contact modules in the vicinity of the second connecting surface.

12. The printed circuit board combination as claimed in claim 11, wherein each of the plurality of second contact modules has an approximate L-shape.

13. The printed circuit board combination as claimed in claim 11, wherein the second connector further comprises a mounting surface which is fixed on the second board when mounting the second connector on the second board, and the mounting surface is parallel to the second direction.

14. The printed circuit board combination as claimed in claim 11, wherein the second connector further comprises a mounting surface which is fixed on the second board when mounting the second connector on the second board, and the mounting surface is inclined with respect to the second direction.

15. The printed circuit board combination as claimed in claim 11, wherein the second connector further comprises a housing configured to accommodate the plurality of second contact modules.

16. The printed circuit board combination as claimed in claim 11, wherein the first board and the second board are arranged perpendicular to each other, and the first contact modules in the vicinity of the first connecting surface and the second contact modules in the vicinity of the second connecting surface are parallel to the second board.

17. The printed circuit board combination as claimed in claim 11, wherein the plurality of second contact modules have approximate L-shapes of mutually different sizes.

18. The printed circuit board combination as claimed in claim 11, wherein the second connector further comprises a shield member interposed between two adjacent second contact modules.

19. The printed circuit board combination as claimed in claim 11, wherein the plurality of second transmission path patterns have third ends opposite the second ends, and the third ends are coupled to a cable.

* * * * *